United States Patent [19]

Nakamura

[11] Patent Number: 4,675,955

[45] Date of Patent: Jun. 30, 1987

[54] BUCKLE FOR WATCH BANDS

[75] Inventor: Seiichi Nakamura, Tokorozawa, Japan

[73] Assignee: Citizen Watch Co., Ltd., Tokyo, Japan

[21] Appl. No.: 812,816

[22] Filed: Dec. 23, 1985

[30] Foreign Application Priority Data

Dec. 25, 1984 [JP] Japan ..... 59-278189

[51] Int. Cl.[4] ..... A44B 1/04

[52] U.S. Cl. ..... 24/656; 24/68 J; 24/265 WS; 24/574; 24/589

[58] Field of Search ..... 24/68 J, 656, 265 WS, 24/68 R, 580, 574, 585, 586, 589, 596, 625, 642, 652, 664

[56] References Cited

U.S. PATENT DOCUMENTS

| | | | |
|---|---|---|---|
| 257,636 | 5/1882 | Atkins | 24/656 X |
| 627,701 | 6/1899 | Mitchell | 24/574 |
| 1,227,598 | 5/1917 | Ellis | 24/265 WS |
| 1,786,943 | 12/1930 | Gammell | 24/68 J |
| 1,980,222 | 11/1934 | Ogush | 24/574 |
| 3,404,440 | 10/1968 | Weiss | 24/265 WS X |
| 4,324,024 | 4/1982 | Fontana | 24/265 WS X |
| 4,359,808 | 11/1982 | Fontaine | 24/265 WS X |

FOREIGN PATENT DOCUMENTS

| | | | |
|---|---|---|---|
| 538720 | 6/1922 | France | 24/68 J |
| 634177 | 11/1927 | France | 24/68 J |
| 89687 | of 1967 | France | 24/265 WS |
| 2242841 | 3/1975 | France | 24/68 J |
| 493017 | 9/1938 | United Kingdom | 24/656 |
| 2082666 | 3/1982 | United Kingdom | 24/589 |

*Primary Examiner*—Kenneth J. Dorner
*Assistant Examiner*—Laurie K. Cranmer
*Attorney, Agent, or Firm*—Birch, Stewart, Kolasch & Birch

[57] ABSTRACT

A buckle including a frame member attached to an end of a band, and a clasping member rotatably attached to an end of another band is disclosed. An engaging projection having a hook portion and beveled portion is provided on the underside of the clasping member and a lock device is provided in the frame member. The lock device includes a slidable first operating member having a beveled edge and a slidable second operating member having a releasing member. The hook portion engages with the beveled edge and the releasing member engages with the beveled portion to push up the clasping member at the disengagement of the hook portion.

20 Claims, 36 Drawing Figures

BUCKLE FOR WATCH BANDS

BACKGROUND OF THE INVENTION

The present invention relates to a buckle having a locking structure for watch bands.

As shown in FIGS. 1*a* and 1*b*, a known buckle for connecting a pair of watch bands 10 and 12 comprises an engaging member 1 secured to the band 12 by a clamping member 7 at a desired position, a clasping member 2 rotatably connected to an end of the band 10, and a hook 3 also rotatably attached to the end of the band 10. Other ends of both bands 10 and 12 are connected to a watch W. As shown in FIG. 1*b*, the buckle is coupled in such a manner that the hook 3 is engaged with an engaging pin 5 provided in the engaging member 1. Then, a grasping end 4 of the clasping member 2 is engaged with another engaging pin 6 over the hook 3 as shown in FIG. 1*c*.

However, since the parts of the buckle were mass-produced, it was difficult to manufacture the parts without defects. Accordingly, the buckle became incidentally disengaged.

In order to eliminate such a disadvantage, a buckle having an additional locking structure was developed and disclosed in UK Pat. No. 2038917, in which a holding member is pivotally mounted on side frames of an engaging member and a clasping member engaged with the engaging member is locked by the holding member. However, such a holding member can catch things during handling to cause the disengagement of the buckle.

FIG. 2 shows another conventional buckle disclosed in Japanese Utility Model Publication No. 58-3538. In this buckle, an engaging member 13 having a rectangular recess 13*a* is secured to one of the watch bands 14 and another engaging member 15 having a rectangular connecting projection 15*a* to be engaged with the recess 13*a* is secured to the other band 16. A connecting rod 17 having a spring 18 is provided in the engaging member 13 to be inserted into a hole 15*b* formed in the connecting projection 15*a*. In order to couple the buckle, connecting projection 15*a* of the engaging member 15 is engaged with the recess 13*a* of the engaging member 13 and the end of the connecting rod 17 is engaged with the hole 15*b* by the spring 18, so that a secure engagement of the buckle can be established. In order to disengage the buckle, a button 17*a* of the connecting rod 17 is manually pulled.

However, such a buckle is easily disengaged by movement such as hard exercise, because of the slight engagement of rod 17 with the hole 15*b*. This slight engagement is caused by structural requirements and operability of the buckle.

SUMMARY OF THE INVENTION

Accordingly, an object of the present invention is to provide a buckle having a locking structure which is easily operated and securely engaged.

According to the present invention, there is provided a buckle for watch bands connected to a watch, comprising, a frame member attached to an end of one of the bands, and a clasping member rotatably attached to an end of the other bands. The buckle has projecting means provided on the underside of the clasping member and having a hook portion and beveled portion, lock means provided in the frame member, the lock means comprising a slidable first operating member having a beveled edge provided to come into contact with the beveled portion of the projecting means and to be engaged with the hook portion, a slidable second operating member having a releasing member with a beveled surface coming into contact with the beveled portion for pushing up the clasping member, both operating members having manipulating lugs projected from opposite sides of the frame member, and engaging means provided on the underside of the clasping member for maintaining the engaged state of the clasping member at the release of the hook portion.

In one aspect of the present invention, the projecting means is a single engaging projection secured to the underside of the clasping member.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1A:
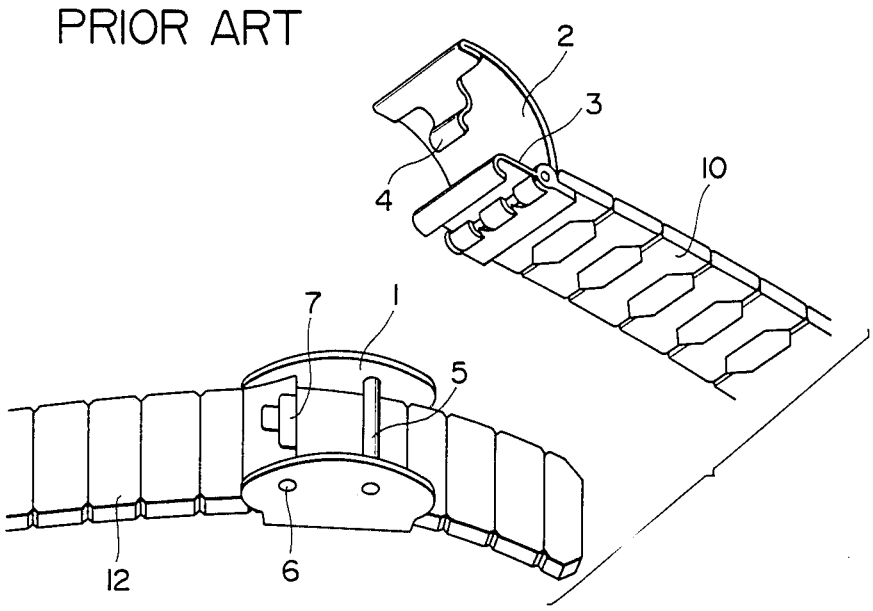
FIG. 1a PRIOR ART
FIG. 1*a* is a perspective view of a conventional buckle.
Figure 1B:
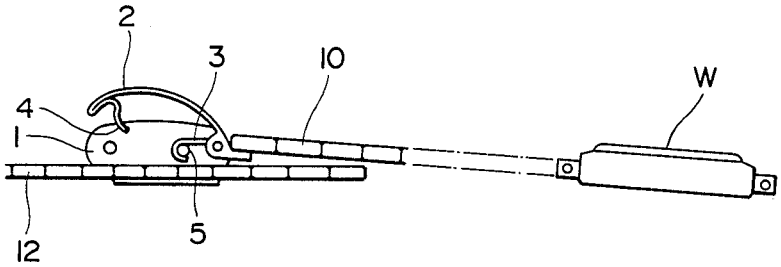
FIG. 1b PRIOR ART
FIGS. 1*b* and 1*c* are side views of the buckle of FIG. 1*a;*
Figure 1C:
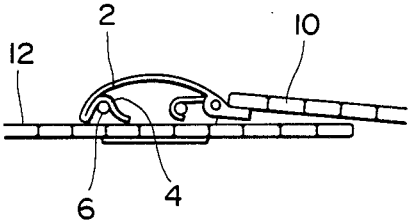
FIG. 1c PRIOR ART
Figure 2A:
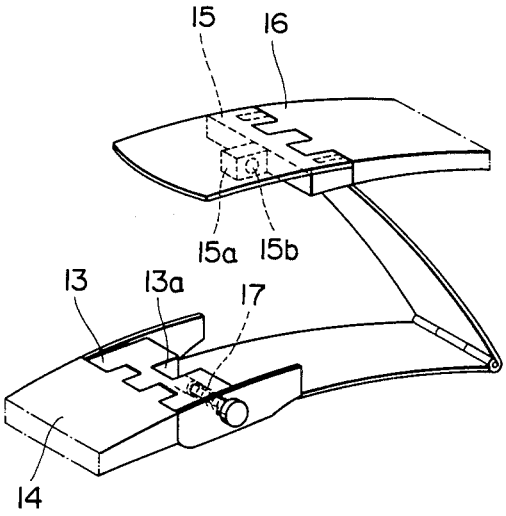
FIG. 2a PRIOR ART
FIG. 2*a* is a perspective view showing another conventional buckle.
Figure 2B:
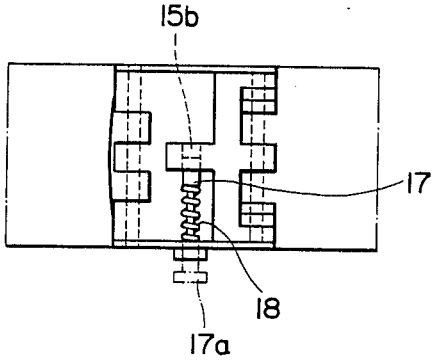
FIG. 2b PRIOR ART
FIG. 2*b* is a plan view of the buckle of FIG. 2*a;*
Figure 3:
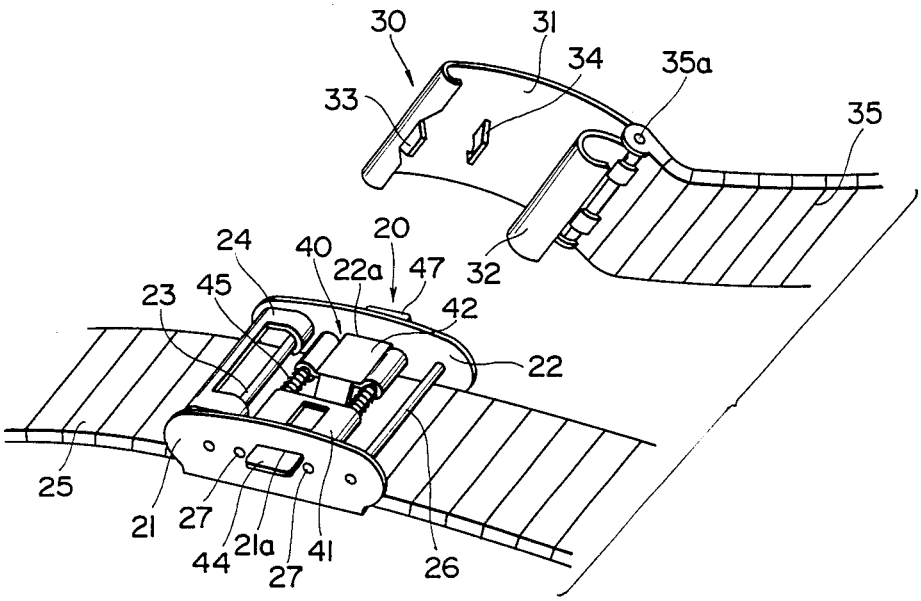
FIG. 3 is a perspective view of a buckle for a watch band according to the present invention.
Figure 4:
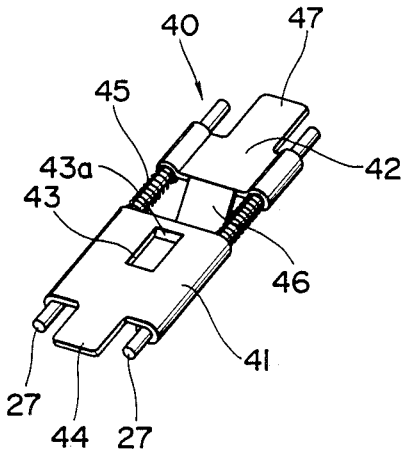
FIG. 4 is an enlarged perspective view of a lock member of the buckle.

Referring to FIGS. 3 to 5, a buckle according to the present invention comprises a frame member 20, a clasp 30, a hook 32, and lock means 40 mounted in the frame member 20. The frame member 20 comprises a pair of side frames 21, 22 integral with a base plate (not shown), and lateral engaging pins 23, 26 provided between side frames. A clamping member 24 is rotatably mounted on the pin 23 for attaching the frame member 20 to a watch band 25. The clasp 30 comprises a clasping member 31 having a grasping end 33 to be engaged with the pin 23 of the frame member 20. Base ends of clasping member 31 and hook 32 are pivotally connected to the other band 35 by a pin 35*a*. An engaging projection 34 is secured to the underside of the clasping member 31 so as to be engaged with the lock means 40. The engaging projection 34 has a hook portion 34*a* and a beveled portion 34*b* (FIG. 5*a*).

Referring to FIG. 4, the lock means 40 comprises a first operating member 41 as a lock member, a second operating member 42 as a pushing up member, a pair of guide pins 27 for slidably mounting the first and second operating members 41, 42, and a pair of coil springs 45 mounted on pins 27 between the first and second operating members. The first operating member 41 has an opening 43 having a beveled edge 43*a* and a manipulating lug 44 laterally projected therefrom between the ends of pins 27. The second operating member 42 has a resilient releasing member 46 downwardly projected between pins 27 and a manipulating lug 47 projected opposite to the lug 44. The releasing member 46 has a beveled surface 46*a*, the end of which is positioned under the first operating member 41 adjacent to the opening 43. The lock means 40 is secured to frames 21, 22 by guide pins 27 and manipulating lugs 44, 47 are projected from holes 21*a*, 22*a*, respectively, formed in the frames 21, 22. The first and second operating members 41, 42 are normally abutted on inside walls of frames 21, 22 by springs 45.

Figure 5A:
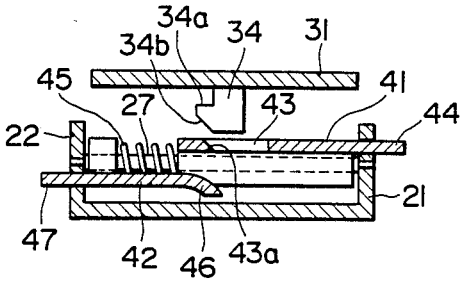
FIGS. 5*a* to 5*e* are cross sectional views each of which shows the engaged state of the buckle of FIG. 3.
Figure 5B:
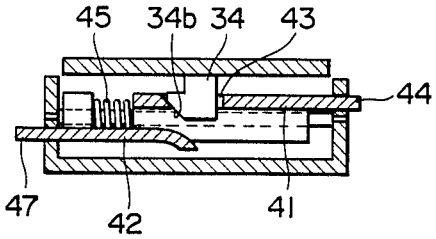
Figure 5C:
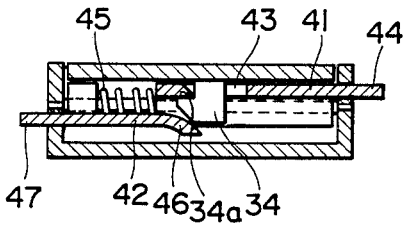

In the engaging operation of the buckle, the hook 32 is engaged with the pin 26 and then the clasping member 31 is rotated to the pin 23 to engage the grasping end 33 therewith. At the same time, the engaging projection 34 is inserted into the opening 43 of the first operating member 41 and beveled portion 34*b* slides on the beveled edge 43*a* to urge the first operating member 41 to the left against the spring 45 (FIG. 5*b*). When the beveled portion 34*b* passes the beveled edge 43*a*, the first operating member 41 is moved to the right by the elastic force of the spring 45, so that the hook portion 34*a* engages with the underside of the periphery of the opening 43 of the first operating member 41 (FIG. 5*c*). Thus, the clasping member 31 is locked by the lock means 40 as the grasping end 33 is engaged with the pin 23.

Figure 5D:
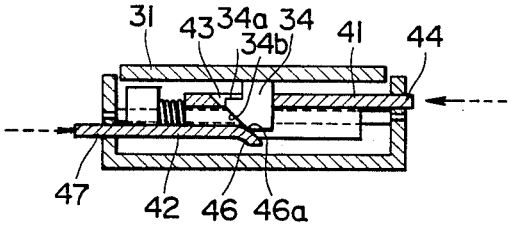
Figure 5E:
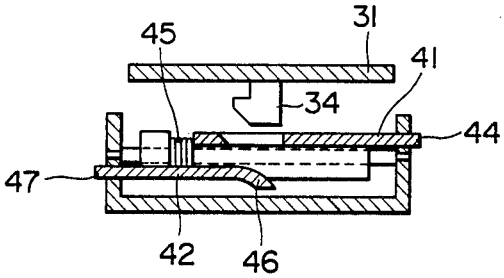

To disengage the buckle, as shown in FIGS. 5*d* and 5*e*, the manipulating lugs 44, 47 are simultaneously pushed. The first operating member 41 is moved so as to position the opening 43 to correspond to the hook portion 34*a*, while the second operating member 42 is moved so that the beveled surface 46*a* of releasing member 46 presses the beveled portion 34*b* to push up the projection 34. Thus, the engaging projection 34 is released from the first operating member 41 and by the pressing force of the releasing member 46, the grasping end 33 is disengaged from the pin 23.

In the locked state, if the manipulating lug 47 is accidentally pushed, the releasing member 46 of the second operating member 42 pushes the beveled portion 34*b* upwardly. However, the hook portion 34*a* is engaged with the first operating member 41, so that the clasping member 31 maintains the engaged state. If the manipulating member 44 is pushed, the first operating member 41 is released from the hook portion 34*a*. However, since the grasping end 33 of the clasping member 31 is engaged with the pin 23, the engagement remains. That is, even if one of manipulating lugs 44, 47 is pushed, the buckle is not unlocked.

Figure 6:
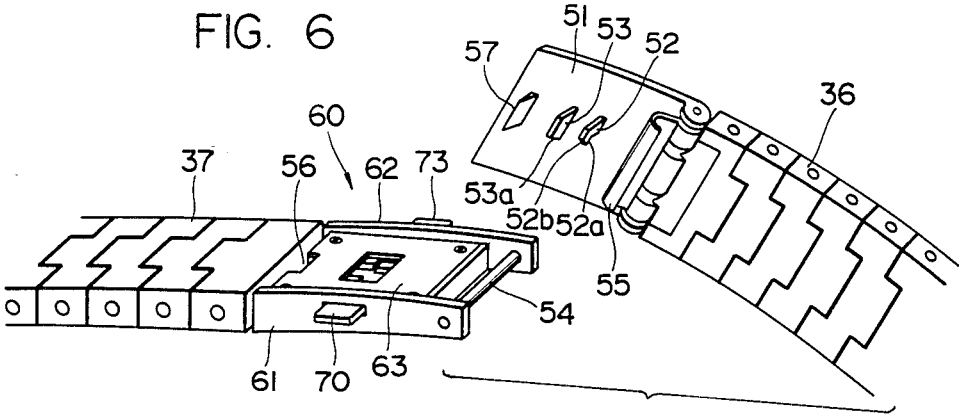
FIG. 6 is a perspective view of a buckle showing a second embodiment of the present invention.

FIGS. 6 to 9 depict another embodiment of the present invention. Referring to FIG. 6, a clasping member 51 pivotally connected to a band 36 has a pair of projections comprising a hook member 52 and a release member 53. The hook member 52 is formed with a hook portion 52*a* having a lower bevel 52*b* (FIG. 8*a*). The release member 53 has a beveled portion 53*a* (FIG. 9*a*).

Figure 7:
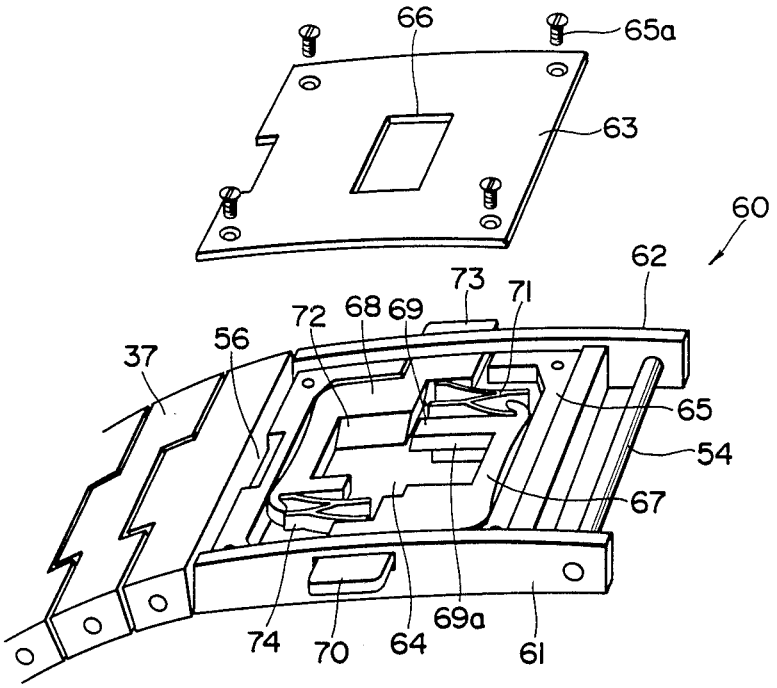
FIG. 7 is a perspective view showing a part of the buckle of FIG. 6.

Referring to FIG. 7, a frame member 60 connected to another band 37 comprises a base frame 65, a pair of side frames 61, 62 integral with the base frame 65, an upper plate 63 having a rectangular opening 66, and a lower plate 64 secured to side frames. The upper plate 63 is secured to the base frame 65 by screws 65*a*. An engaging pin 54 is laterally provided between side frames 61, 62 so as to be engaged with a hook 55 pivotally connected to the band 36. An engaging recess 56 is formed in the base frame 65 for engaging a grasping end 57 of the clasping member 51. A pair of operating members 67, 68 are slidably mounted in the frame member 60 so as to be engaged with projections 52, 53 of the clasping member 51. The first operating member 67 as a lock member comprises a holding portion 69 having a bevel 69*a*, a manipulating lug 70 projected from the side frame 61, and a spring plate 71 secured thereto opposite to the lug 70. A second operating member 68 as a pressing up member comprises a beveled portion 72, a manipulating lug 73 projected from the side frame 62, and a spring plate 74 secured thereto. The free end of the spring plate 71 is abutted on the second operating member 68 and the free end of the spring plate 74 is engaged with the first operating member 67.

Figure 8A:
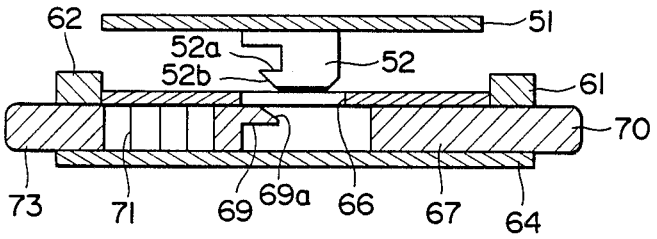
FIGS. 8*a* to 8*d* are cross sectional views showing engaged states of the buckle.
Figure 8B:
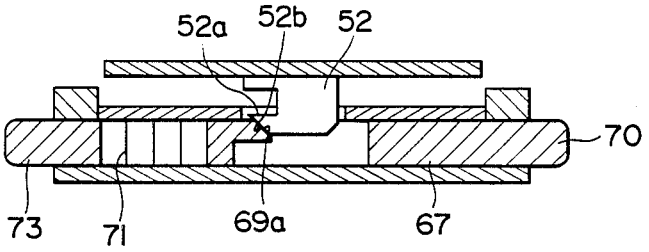
Figure 8C:
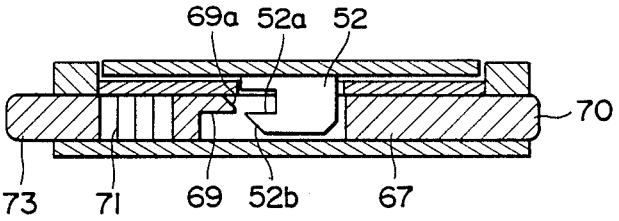
Figure 8D:
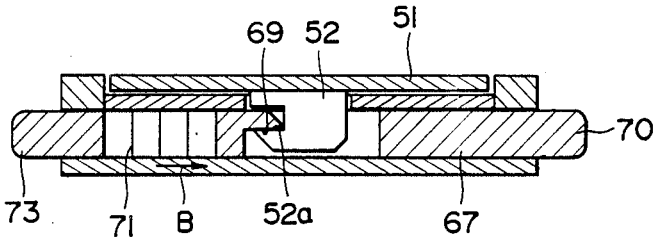

In order to couple the buckle, the hook 55 is engaged with the pin 54 and the clasping member 51 is rotated to engage the grasping end 57 with the engaging recess 56. FIGS. 8 and 9 show respective engaging states of projections with operating members. The projections 52, 53 are disposed on a space defined by first and second operating members 67, 68. As shown in FIG. 8*b*, bevel 52*b* of the hook member 52 slides on the bevel 69*a* so that the first operating member 67 is pushed against the spring 71 as the clasping member 51 is depressing. As shown in FIGS. 8*c* and 8*d*, when the bevel 52*b* passes the bevel 69*a*, the first operating member 67 is moved in the direction of an arrow B by the elastic force of the spring 71, so that the holding portion 69 engages with the hook portion 52*a*. Thus, the hook member 52 is locked by the first operating member 67, while the release member 53 engages with the second operating member 68 and the grasping end 57 is fitted in the recess 56.

Figure 9A:
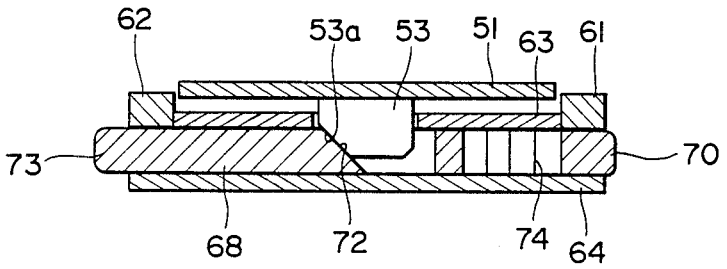
FIGS. 9*a* and 9*b* are cross sectional views showing disengaged states of the buckle.
Figure 9B:
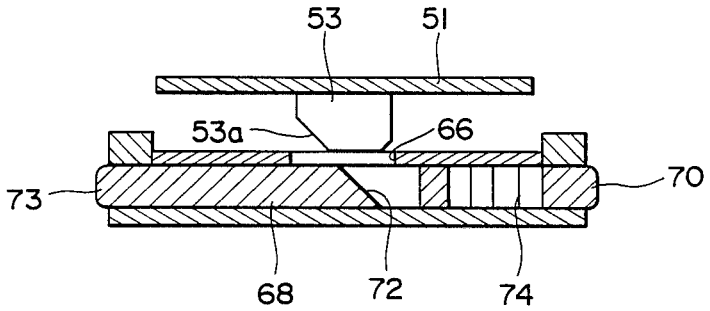

In order to disengage the buckle, the manipulating lug 70 is pushed to release the hook portion 52*a* from the holding portion 69. Then as shown in FIGS. 9*a* and 9*b*, by pushing the lug 73, the beveled portion 72 is abutted on the beveled portion 53*a* and pushes the portion 53*a* upward. Thus, the porjections 52, 53 are pushed up and released from first and second operating members 67, 68. By the upward force, the grasping end 57 is disengaged from the recess 56.

In this embodiment, since first and second operating members are disposed in the same plane, a thinner buckle can be provided.

FIGS. 10 to 15 show modifications of the second embodiment shown in FIGS. 6 to 9.

Figure 10:
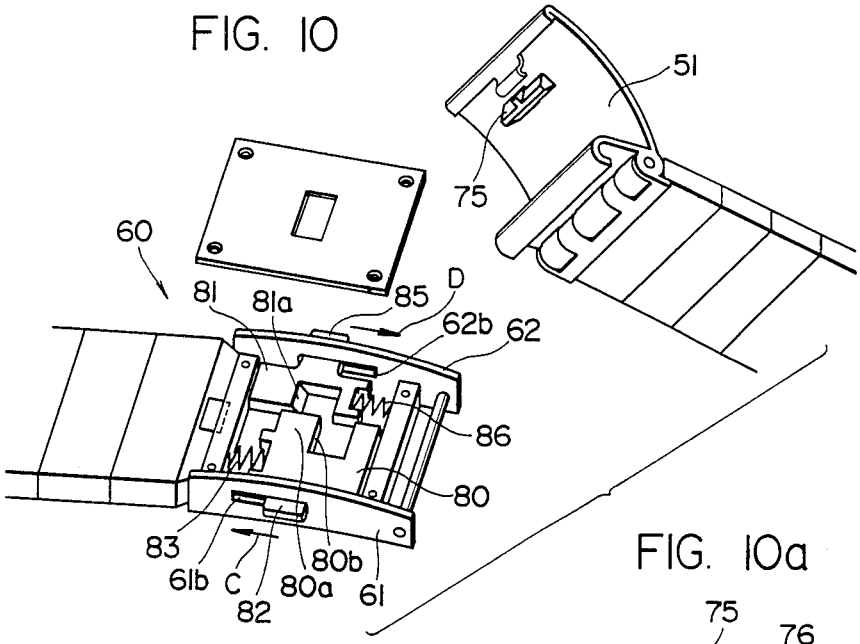
FIG. 10 is a perspective view of a buckle showing a modification of FIG. 6.
Figure 10A:
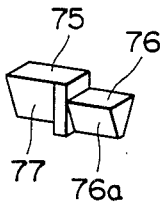
FIG. 10*a* is an enlarged perspective view of an engaging projection.
Figure 11:
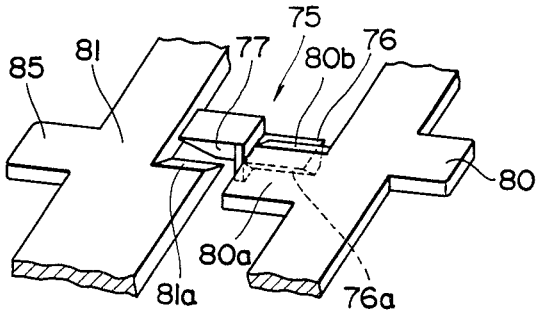
FIG. 11 is a perspective view partially showing a locking state of a locking structure of the buckle of FIG. 10.

Referring to FIGS. 10 to 11 showing a first modification, an engaging projection 75 comprises a hook portion 76 having a lower bevel 76*a* and a beveled portion 77. A first operating member 80 having a holding portion 80*a* and a second operating member 81 having a beveled portion 81*a* are longitudinally slidably mounted in the frame member 60 and biased in the opposite direction to each other by respective springs 83, 86. Each of manipulating lugs 82, 85 is slidably engaged with elongated holes 61*b*, 62*b* of side frames 61, 62, respectively. Although, in the previous embodiments, operating members are provided to be moved in the lateral direction with respect to the band, the operating members 80 and 81 are movable in the longitudinal direction. The other parts of the structure are the same as the second embodiment and the same parts thereof are identified with the same reference numerals as in FIGS. 6 to 9.

Referring to FIG. 11, in engagement of the buckle, the bevel 76*a* of the engaging projection 75 slides on a bevel 80*b* formed on a holding portion 80*a* of the first operating member 80, and then the hook portion 76 engages the holding portion 80*a*, while the beveled portion 77 is disposed in the second operating member 81. For disengaging the buckle, the manipulating lug 82 is caused to slide in the direction of an arrow C, and holding portion 80*a* of the first operating member 80 is released from the hook portion 76. Then, the manipulating lug 85 is caused to slide in the direction of an arrow D as the lug 82 is sliding, so that beveled portion 77 is pushed up by the beveled portion 81*a* of the second operating member 81.

Accordingly, such a buckle can be used for a lady's watch band which has a relatively small width.

Figure 12:
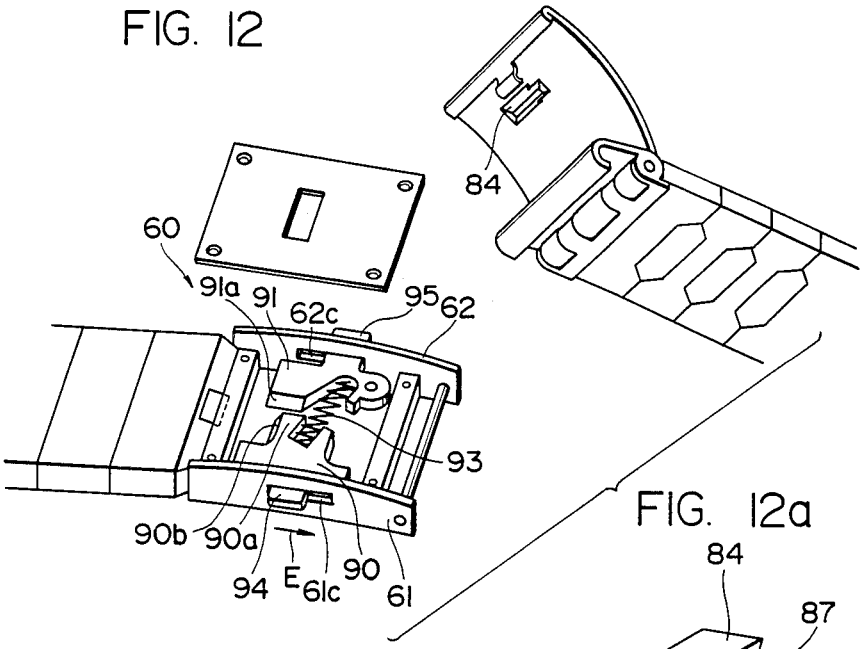
FIG. 12 is a perspective view of a second modification of FIG. 6.
Figure 12A:
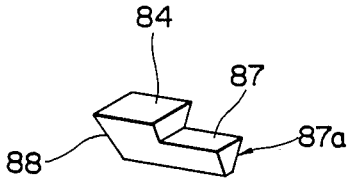
FIG. 12*a* is a perspective view of an engaging projection.
Figure 13:
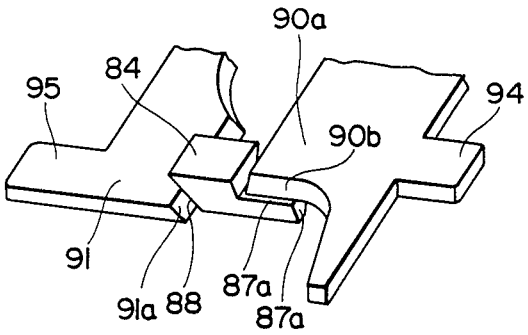
FIG. 13 is a perspective view partially showing a locking state of FIG. 12.

Referring to FIGS. 12 to 13, an engaging projection 84 of a second modification has a hook portion 87 and a beveled portion 88. A first operating member 90 having a holding portion 90*a* and a second operating member 91 having a beveled portion 91*a* are longitudinally slidably mounted in the frame member 60 opposed to each other and a spring 93 is provided there-between. A manipulating lug 94 of the first operating member 90 is slidably engaged with an elongated hole 61*c* of the side frame 61 and a manipulating lug 95 of the second operating member 91 is projected from a hole 62*c* of the frame 62.

For engaging the buckle, as shown in FIG. 13, the projection 84 is inserted into a space between first and second operating members 90, 91, and a lower bevel 87*a* of the hook portion 87 slides a bevel 90*b* of the holding portion 90*a*, and then the holding portion 90*a* is engaged with the hook portion 87. In order to disengage the buckle, manipulating lug 94 of the first operating member is moved in the direction of an arrow E to release the holding portion 90*a* from the hook portion 87. Then, manipulating lug 95 of the second operating member is pushed so that the beveled portion 91*a* abuts on the beveled portion 88 to push up the projection 84.

Figure 14:
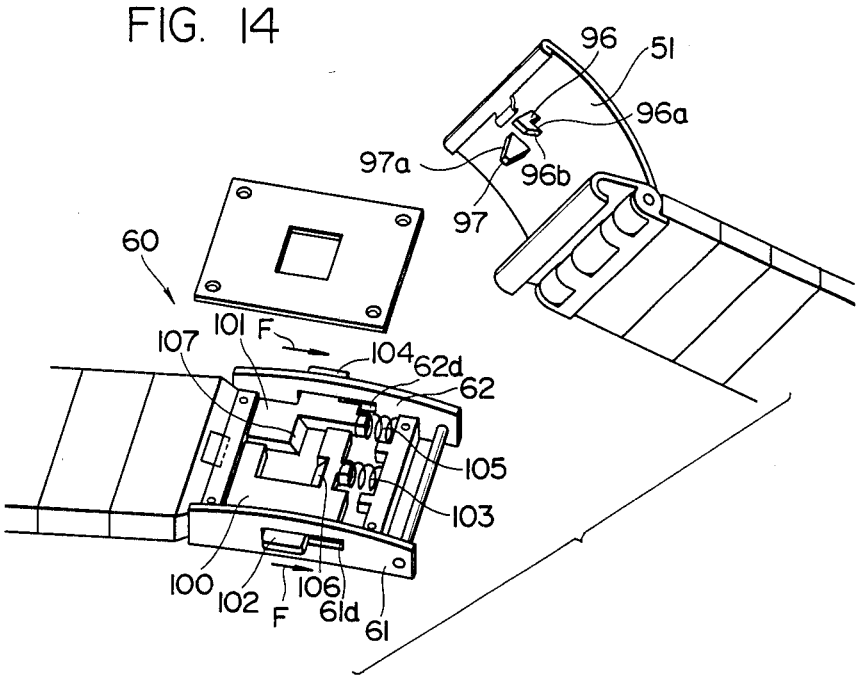
FIG. 14 is a perspective view of a third modification of FIG. 6.
Figure 15:
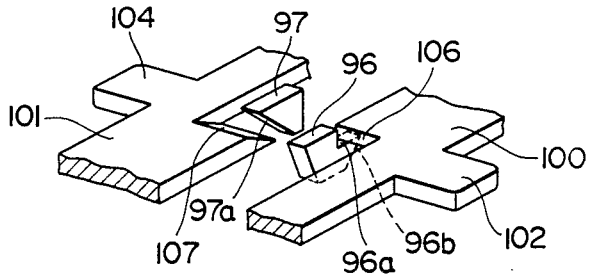
FIG. 15 is a perspective view partially showing a locking state of FIG. 14.

Referring to FIGS. 14 and 15 showing a third modification, a pair of projections comprising a hook member 96 and a release member 97 are laterally provided on the underside of clasping member 51. The hook member 96 is formed with a hook portion 96*a* having a bevel 96*b* and the release member 97 has a beveled portion 97*a*. A first operating member 100 having a holding portion 106 and a second operating member 101 having a beveled portion 107 are slidably mounted in the frame member 60 and biased in the same longitudinal direction by springs 103, 105, respectively. Each of manipulating lugs 102, 104 of the members is slidably engaged with elongated holes 61*d*, 62*d*, respectively, formed in side frames.

In the engagement of the buckle, the bevel 96*b* of the hook member 96 is pressed against a bevel of the holding portion 106, and then the hook portion 96*a* is held by the holding portion 106. In the disengagement, manipulating lugs 102, 104 are caused to slide in the direction of arrows F, so that the holding portion 106 is released from the hook portion 96*a* and the beveled portion 107 is pressed to the beveled portion 97*a* to push up the release member 97. Thus, the buckle is disengaged.

Figure 16:
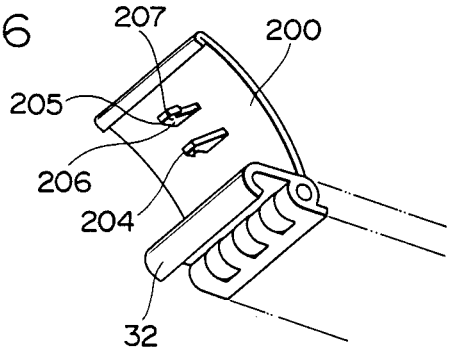
FIG. 16 is a perspective view of a clasping member of the buckle of a third embodiment of the present invention.
Figure 17:
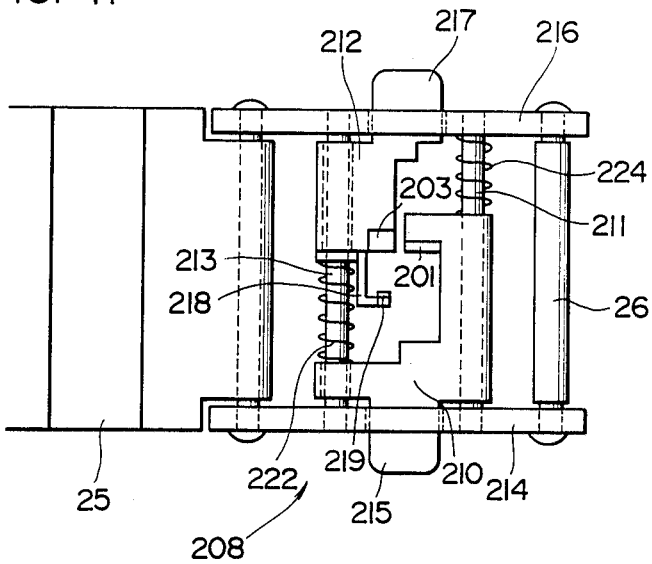
FIG. 17 is a plan view of a frame member of the buckle of FIG. 16.
Figure 17A:
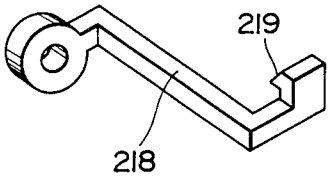
FIG. 17*a* is a perspective view of an engaging member of the frame member.

FIGS. 16 to 18 show a further embodiment of the present invention. A clasping member 200 without a grasping end has a pair of projections comprising a hook member 204 and a release member 206. The relase member 206 is provided for engaging the clasping member 200 with a frame member 208 in place of the grasping end of the previous embodiments. The release member 206 has a beveled portion 205 and a hook portion 207. The frame member 208 comprises a pair of frames 214, 216, a first operating member 210 having a lock portion 201 and slidably mounted on a pair of shafts 211, 213 which are laterally provided between frames, and a second operating member 212 having a beveled portion 203 and slidably mounted on the shaft 213. A coil spring 224 is mounted on the shaft 211 between the frame 216 and first operating member 210 and another coil spring 222 is mounted on the shaft 213 between first and second operating members. An engaging member 218 having an engaging end 219 to be engaged with the release member 206 is mounted on the shaft 213 adjacent to the second operating member 212 and urged to the second member by the spring 222.

Figure 18A:
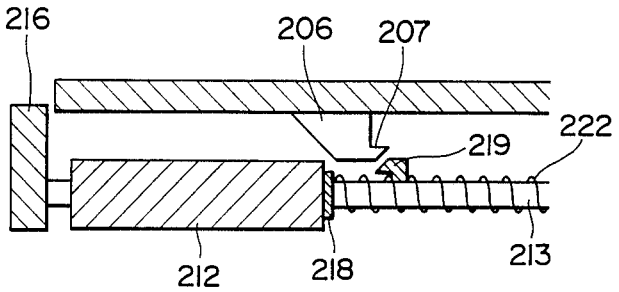
FIGS. 18*a* to 18*e* are cross sectional views partially showing engaging states of the third embodiment.
Figure 18B:
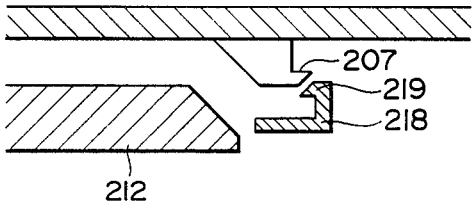
Figure 18C:
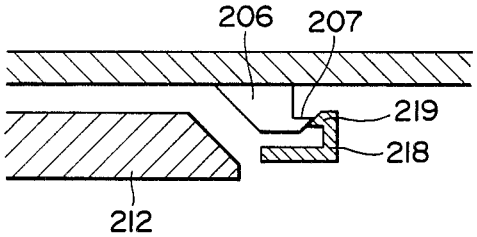
Figure 18D:
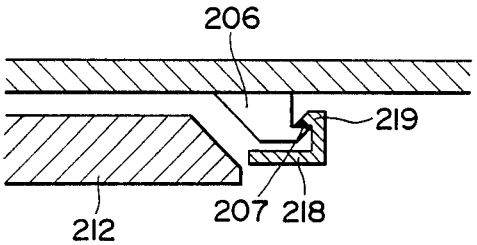
Figure 18E:
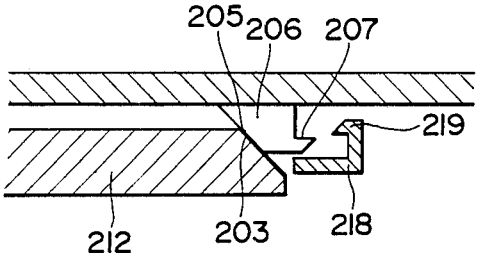

When the clasping member 200 is engaged with the frame member 208, the hook portion 207 of the release member 206 is engaged with the engaging end 219. Referring to FIGS. 18*a* to 18*e*, a lower bevel of the hook portion 207 slides on a bevel of the engaging end 219 against the spring 222. Then, the hook portion 207 is engaged with the engaging end 219 as shown in FIG. 18*d*. At the same time, the hook member 204 is locked by the lock portion 201. In order to disengage the buckle, a manipulating lug 215 of the first operating member 210 is pushed to release the hook member 204 from the hook portion 201. Then, a manipulating lug 217 of the second operating member 212 is pushed so that the engaging member 218 is simultaneously pushed against the spring 222. Thus, as shown in FIG. 18*e*, the engaging end 219 is released from the hook portion 207, and at the same time, the beveled portion 205 is pushed up by the beveled portion 203 of the second operating member 212.

In accordance with the present invention, the locking structure is simultaneously locked without additional operation when the buckle is coupled.

Usually, in order to disengage a conventional buckle, the clasping member is opened by the finger nail of the wearer. In the present invention, the locking structure is released by operating a pair of manipulating lugs at the same time the clasping member is released. Further, the locking structure is not released even if one of manipulating lugs is separately operated. Accordingly, a locking structure for a buckle having a secure engagement can be provided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A buckle for connecting ends of a watch band together, comprising:

a clasping member for rotatably attaching said buckle to one end of said watch band and a frame member for engaging with said clasping member and for attaching said buckle to the remaining end of said watch band, said clasping member comprising:

means projecting from one side of said clasping member, having a first hook portion including an engaging surface parallel to said one side of said clasping member and having a beveled portion inclined to said one side of said clasping member, and a first engaging means provided on said one side of said clasping member;

said frame member comprising:

a second engaging means provided thereon for receiving said first engaging means to form a connection therebetween, and a lock means provided in said frame member for allowing an interlocking connection between said projecting means and said lock means, said lock means including:

a slidable first operating member having a beveled edge for contacting said beveled portion of said projecting means and having an underside for engaging a surface of said first hook portion of said projecting means, a slidable second operating member, having a releasing member with a beveled surface for contacting said beveled portion of said projecting means, at least one spring means for urging said first operating member so that said hook portion engages with said underside of said first operating member, and lugs, each operatively connected to said first and second operating members and projecting from opposite sides of said frame member, for releasing said connection between said first engaging means and said second engaging means and said interlocking connection between said lock means and said projecting means by simultaneous movement of said lugs.

2. The buckle according to claim 1, wherein said projecting means is connectable to said lock means via an aperture formed in said first operating member.

3. The buckle according to claim 1, wherein said lugs are positioned so that said simultaneous movement of said lugs causes said beveled surface of said releasing member to exert an upward force on said projecting means.

4. The buckle according to claim 1, wherein said lugs are positioned so that said simultaneous movement of said lugs is in a direction perpendicular to a longitudinal axis of said band.

5. The buckle according to claim 1, wherein said lugs are positioned so that said simultaneous movement of said lugs is in a direction parallel to said band.

6. The buckle according to claim 1, wherein said frame member further includes a pair of side plates formed integrally with a base plate, and at least one lateral pin provided between said plates.

7. The buckle according to claim 6, further comprising a clamping member rotatably mounted on said at least one lateral pin.

8. The buckle according to claim 6, wherein said at least one lateral pin includes two lateral pins, and further comprising a hook member provided on said clasping member for engaging one of said two lateral pins and forming a connection therebetween.

9. The buckle according to claim 1, wherein said lock means further includes a pair of guide pins for slidably mounting said first and second operating members.

10. The buckle according to claim 9, wherein said at least one spring means includes a pair of springs mounted on said pins between said first and second operating members.

11. The buckle according to claim 1, wherein said projecting means includes two members, one of said members having a hook portion and the other of said members having a beveled portion.

12. The buckle according to claim 11, wherein said lugs are positioned so that said simultaneous movement of said lugs is in a direction perpendicular to said band.

13. The buckle according to claim 11, wherein said lugs are positioned so that said said simultaneous movement of said lugs is in a direction parallel to a longitudinal axis of said band.

14. The buckle according to claim 11, wherein said first operating member forms a connection with said hook portion and said beveled portion forms a connection with said second operating member.

15. The buckle according to claim 14, wherein said second engaging means is a recess formed in said frame member.

16. The buckle according to claim 14, wherein said first and second operating members are disposed in a single plane.

17. A buckle for connecting ends of a watch band together, comprising:

a clasping member for rotatably attaching said buckle to one end of said watch band and a frame member for engaging with said clasping member and for attaching said buckle to the remaining end of said watch band, said clasping member comprising:

a hook member and a release member projecting from said clasping member, said release member having a beveled portion and a hook portion;

said frame member comprising:

a lock means provided in said frame member for allowing an interlocking connection between said clasping member and said lock means, said lock means including:

a slidable first operating member for engaging said hook member to form a connection therebetween, a slidable second operating member, an engaging member for engaging with said hook portion of said release member to form a connection therebetween, a first lug, operatively connected to said first operating member and projecting from said frame, for releasing said hook member from said first operating member by movement of said first lug, and a second lug, operatively connected to said second operating member and projecting from said frame, for releasing said release member from said engaging member by movement of said second lug simultaneous with said movement of said first lug.

18. The buckle according to claim 17, further comprising a pair of shafts provided in said frame member for slidably mounting said first and second operating members.

19. The buckle according to claim 18, further comprising a first spring means mounted on one of said shafts between said frame and said first operating member and a second spring means mounted on the other of said shafts between said first and second operating members.

20. The buckle according to claim 19, wherein said engaging member is mounted on the same shaft as said second spring means so that said second spring means urges said engaging member toward said second operating member.

* * * * *